US009642400B1

(12) United States Patent
Cauthen et al.

(10) Patent No.: US 9,642,400 B1
(45) Date of Patent: May 9, 2017

(54) MANUAL TRANSFER VEST

(71) Applicants: Peggy S. Cauthen, Brandenton, FL (US); Cathy J. Foster, Collierville, TN (US)

(72) Inventors: Peggy S. Cauthen, Brandenton, FL (US); Cathy J. Foster, Collierville, TN (US)

( * ) Notice: Subject to any disclaimer, the term of this patent is extended or adjusted under 35 U.S.C. 154(b) by 190 days.

(21) Appl. No.: 14/698,838

(22) Filed: Apr. 28, 2015

Related U.S. Application Data

(63) Continuation of application No. 13/901,507, filed on May 23, 2013, now Pat. No. 9,015,880.

(51) Int. Cl.
*A41D 1/04* (2006.01)

(52) U.S. Cl.
CPC ..... *A41D 1/04* (2013.01)

(58) Field of Classification Search
CPC ..... A41B 13/10; A41D 1/04; A41D 13/0007; A41D 13/1236; A41F 19/00; A41F 19/002; A41F 19/007; A41F 19/025
USPC ..... 5/81.1 T, 81.1 R, 89.1, 83.1; 2/114, 75
See application file for complete search history.

(56) References Cited

U.S. PATENT DOCUMENTS

2011/0283446 A1* 11/2011 Baldauf ..... A41D 13/05 2/462
2012/0137417 A1* 6/2012 Pease ..... A41F 9/005 2/463
2012/0180205 A1* 7/2012 Herring ..... A41D 13/0007 2/463
2012/0324630 A1* 12/2012 O'Brien ..... A41D 27/02 2/236
2014/0150161 A1* 6/2014 Nykoluk ..... A41D 13/0007 2/102
2014/0237698 A1* 8/2014 Murphy ..... A41D 13/0007 2/69

* cited by examiner

*Primary Examiner* — Robert G Santos
*Assistant Examiner* — Myles Throop
(74) *Attorney, Agent, or Firm* — Dorothy S. Morse

(57) ABSTRACT

A manual transfer vest which aids in compensating for fatigue, pain, loss of strength, mobility, and energy in the daily life of patients and/or individuals/caregivers assisting them. It comprises soft, lightweight, and preferably washable material that enwraps the patient's torso, and also has at least seven non-adjustable hand-grip lift components with sturdy and durable construction and attachment. In some preferred embodiments, nine hand-grip lift components are used, with six hand-grip lift components preferably situated bilaterally on the vest front, and three hand-grip lift components situated on the vest back. For vest durability during repeated patient lifting, reinforcement lining stitching is secured adjacent to or near at least one end of all hand-grips lift components. Interior adjustment ties, padded neck and armhole openings, mesh fabric, and a collar may also contribute to patient comfort. Overall, the manual transfer vest promotes safety in preventing injuries, thereby reducing medical costs.

19 Claims, 7 Drawing Sheets

MANUAL TRANSFER VEST

CROSS-REFERENCES TO RELATED APPLICATIONS

This patent application relates to a previously filed and still pending U.S. non-provisional patent application filed by the same inventors herein. It has the Ser. No. 13/901,507, was filed on May 23, 2013, and has the title of "Manual Transfer Vest". Since the inventions in both applications have structural similarity to one another and common subject matter, the applicants herein respectfully request a grant of domestic priority for this current patent application herein with improvements based upon their previously filed U.S. Ser. No. 13/901,507.

BACKGROUND OF THE INVENTION

Field of the Invention

The present invention relates to patient transfer systems and, particularly to a manual patient transfer system in the form of a vest comprising several multi-functional patient assistive transfer features, which compensates at least in part for fatigue, pain, loss of strength, loss of mobility, and lack of energy in the daily life of moderately mobility-challenged patients or individuals who are still ambulatory but have difficulty in rising from a sitting position into a standing position. However, the present invention can also be used for other patient transfers, such as, but not limited to, lateral bed transfers and repositioning maneuvers.

Description of the Related Art

According to the CDC, each year in the United States one in three adults age 65 and older suffers a fall. The death rate from falls among older U.S. men and women has risen sharply, and falls are now their leading cause of early death. While not always being an immediate cause of death, falls can cause moderate to severe injuries, such as hip fractures and traumatic brain injuries, which accelerate death. Medical journals document that nursing homes with one hundred beds may annually experience as many as 100-200 patient falls. Other causes for nursing homes falls can include "transfer" difficulty (for example moving a patient from a bed to a chair), poor foot care, poor fitting shoes and improper or incorrect use of walking aids. In addition, medical journals and other publicly available medical information further documents that for the year 2000 the total annual estimated cost in the U.S. relating to nonfatal, fall-related injuries was at least $16 billion. For hip fractures alone, the average cost per patient during the first year of occurrence is at least $25,000, with a lifetime cost of sustaining a hip fracture approximately $81,300 (of which approximately half was spent on nursing home care). Every year, falls among older people cost the nation more than $20.2 billion in direct medical costs. Medicare costs for hip fractures are almost $3 billion annually. By 2020, the total annual cost of these injuries is expected to reach $32.4 billion.

In addition, the high physical demands associated with the handling and moving of patients is probably the largest contributing factor to high rates of musculoskeletal disorders (MSD) among practicing nurses and caregivers. Work-related MSD, such as back and shoulder injuries, persist as the leading and most costly U.S. occupational health problem due to the cumulative effect of repeated manual patient-handling activities as well as patient transfers done in extreme static awkward postures. The present invention manual transfer vest is designed and constructed to assist practicing nurses and caregivers in handling and moving patients (obese and non-obese) without injury to themselves or to the patient, including patient fall prevention, with use contemplated by professionals and staff in hospitals, nursing homes, and assisted living facilities, but not limited thereto, as well as by people at home taking care of a family member.

In their observations as Registered Nurses, the inventors herein have found that in addition to obese populations, the elderly and disabled are in great need of transfer assistive devices that are better focused on transferring the patient with the highest level of comfort and safety possible, and also provide benefit to the caregiver by reducing the risk of caregiver MSD. Without an assistive device, one or more people are needed to lift an individual into a standing position, typically using the arms. Particularly for elderly populations, as well as other populations who require assistance with ambulation, repeated pulling on the arms can be uncomfortable for individuals attempting to stand, and may lead to arm soreness and other injuries. Also, the disabled often do not have the muscular-skeletal capability or coordination to assist a caregiver during attempts to move them, which places more of a physical burden on the caregiver. The present invention transfer assistive device herein, in the form of a vest, is a non-mechanical lift and patient repositioning device intended to reduce the risk and injuries associated with the populations mentioned hereinabove. The main objectives of the present invention are to promote patient safety, dignity, mobility and independence, which in turn will enhance their quality of life. The present invention has been developed with the safety, comfort and well-being of the patient and caregiver in mind.

Use of the present invention manual transfer vest is not only contemplated for people attempting to rise from a seated position into a standing position when a risk of falling is greatly increased, but also for moderately mobility-challenged patients or individuals who are still ambulatory but in need of assistance while walking to prevent a fall. The front lifting components in the present invention vest assist a person standing in front of a seated patient to slowly, steadily, and in a controlled manner pull the seated patient toward them, until the seated patient has reached a standing position, with a combination of front and back lifting components being used by one or two caregivers to stabilize an ambulatory patient from one or both sides while walking occurs. Other patient transfers can also be assisted by use of the present invention, such as but not limited to lateral bed transfers and repositioning maneuvers. Many transfer assistive devices for patients and others are known, however, each has undesirable limitations which are overcome by the present invention. The present invention is intended to be worn continuously by patients while movement and mobility challenges exist, even while sleeping, and overcomes all disadvantages of the known prior art.

BRIEF SUMMARY OF THE INVENTION

The primary objective of this invention is to provide a manual patient transfer assistive device in the form of a vest that is able to transfer an elderly, disabled, or obese patient with the highest level of comfort and safety possible to the patient and the person or persons aiding the patient. It is also an objective of this invention to provide a manual patient transfer assistive device that allows transfer of most elderly, disabled, and obese patients by one person. A further objective of this invention is to provide a manual patient transfer assistive device easily capable of achieving more than one patient transfer function. Another objective of this invention is to provide a manual patient transfer assistive device that allows patient transfers to be done in extreme static awkward postures without injury to the patient or the person aiding the patient. It is a further objective of this invention to provide a manual patient transfer assistive device that consists of well-designed, strong, and durable construction. Furthermore, it is an objective of this invention is to provide a manual patient transfer assistive device with visible and/or concealed size adjustment means to better accommodate patients during weight loss or gain. Another objective of this invention is to provide a manual patient transfer assistive device that is made of soft, lightweight, and easily washable materials. It is also an objective of this invention to provide a manual patient transfer assistive device that is comfortable when a patient is seated or sleeping, and does not get in the way during use of a commode. In addition, it is an objective of this invention to provide a manual patient transfer assistive device that facilitates patient independence while maintaining dignity, and may be made with or without a collar. A further objective of this invention is to provide a manual patient transfer assistive device for continuous or near continuous wear by moderately mobility-challenged patients, which has enhanced aesthetic appeal that does not visibly highlight a patient's movement challenges and instead makes patients feel as if they were wearing conventional and/or stylish clothing.

The present invention is a practical, efficient and well-designed manual multi-functional transfer device that is compact, lightweight, and easily capable of achieving more than one patient transfer function. It can be used with moderately mobility-challenged patients, and also used to promote a steady gait for safe patient ambulation. Using the manual transfer vest, one person usually can slowly, gently, evenly, steadily, and in a controlled manner, bring a seated patient into a standing position by pulling on the two lower vertically-extending and non-adjustable hand-grip lift components on the front of the vest that are closer to the abdominal/mid-section area of the person wearing the manual transfer vest. Should a patient be more difficult to maneuver, two people standing on opposite sides of a seated patient can bring the patient into a standing position by each simultaneously pulling on one of the upper front hand-grip lift components and on one of the upper back hand-grip lift components. Examples of other patient transfer activity that can be accomplished using the present invention include, but are not limited to, frontal transfers, lateral bed transfers, controlled stand-to-sit transitions, and repositioning maneuvers. The present invention manual transfer vest has flexible and durable material, which is also preferably lightweight for added patient comfort. However, for use in colder climates, the present invention manual transfer vest may comprise heavier material and/or more layers for added patient warmth. The preferred zippered or hook-and-loop front closure of the present invention manual transfer vest allows for easy on and off access while offering a comfortable fit. Raising a patient to a standing position using the hand-grip lift components of the present invention instead of patient arms, minimizes risk factors that can lead to patient or caregiver injury while increasing comfort for the patient wearing the manual transfer vest during needed transitions. To accommodate differing patient size, and provide a good fit for patient lifting and transfers, it is contemplated for the present invention manual transfer vest to be commercially available in more than one size, with visible and/or hidden additional size-adjustment means also present. Darts and indented side seams may also be used to provide a foot fit. The manual transfer vest of the present invention helps to minimize risk factors that can lead to patient or caregiver injury, while also offering style and warmth. Its functionality further enhances a patient's or individual's safety, mobility, and stability during ambulation and transfer, while also facilitating independence and maintaining dignity. No invention is known having the same structure and providing the same benefits as the present invention.

BRIEF DESCRIPTION OF THE SEVERAL VIEWS OF THE DRAWINGS

FIG. 1 also shows two non-adjustable side hand-grip lift components each extending from a different one of the angled reinforcement straps laterally toward the vest's adjacent side seam, a side fit-adjustment area under each armhole, and soft material added around the neck and arm openings for added user comfort.

COMPONENT LIST

Figure 1:
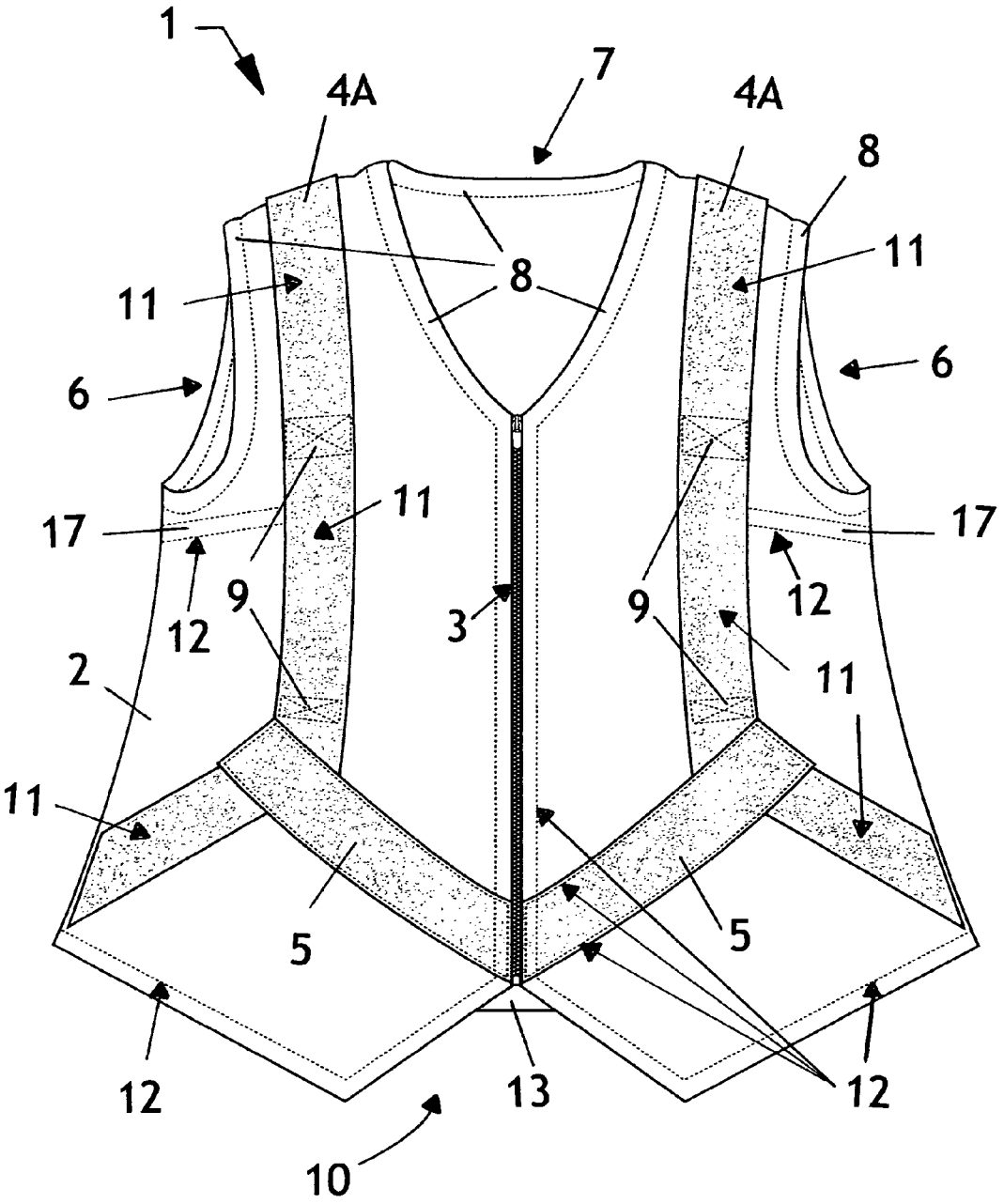
FIG. 1 is a front view of the most preferred embodiment of the present invention manual transfer vest with a zippered front closure and four frontal vertically-extending and non-adjustable hand-grip lift components, two of which are upper hand-grip lift components located in the clavicle/upper chest area adjacent to the shoulders of the person wearing the vest, and two of which are lower hand-grip lift components located lower on the vest closer to the abdominal/mid-section area of the person wearing the vest, with the vest also having reinforcement in key places for the hand-grip lift components to make certain that they remain strong during the lifting of heavy patients and patient lifting that occurs from static and sometimes awkward positions.

1—most preferred embodiment of manual transfer vest
1'—second preferred embodiment of manual transfer vest
1"—third preferred embodiment of manual transfer vest
1'—fourth preferred embodiment of manual transfer vest
2—front vest material
3—front closure (not limited to a zipper, also could be heavy duty hook-and-loop material, or other sturdy closure means, also although front centering of the closure is preferred, it is not critical)
4A—front portion of vertical lifting strap
4B—back portion of vertical lifting strap
5—angled reinforcement strap
6—enlarged arm hole
7—enlarged neck opening (for comfort and to prevent a sense of restriction around the neck should the vest material undergo any shift in position relative to patient during a transfer)
8—padding
9—stitched reinforcement area adjacent to hand-grip lift components 11
10—front void space for user comfort while seated (also allows the two opposed edges in the lower portion of front vest material 2 on each side of the void space to be easily grasped by the user or a caregiver to pull down front vest material 2 during or after a patient transfer is made so that the lower front part of enlarged neck opening 7 does not become, or remain, uncomfortably positioned against the patient's neck)
11—non-length-adjustable hand-grip lift component (created from a portion of lifting straps 4A/4B and other straps 19, 21, and 25)
12—attachment stitching (used for securing lifting straps 4A/4B and angled reinforcement strap 5 to front vest material 2, securing lifting straps 4A/4B to front vest material 2 and back vest material 13, and securing interior lining material 15 to the shortened lower portion of vest back 14)
13—back vest material
14—shortened bottom edge of back vest material (prevents patient from sitting on vest and interference during use of a commode)
15—interior lining material (secured to front vest material 2 and back vest material 13)
16—interior adjustment ties
17—interior casing material (used to carry ties 16 and interior adjustment of front vest material 2 or back vest material 13)
18—side seam connecting front vest material 2 to back vest material 13 below armholes 6 (helps to secure some ties 16 and the lower ends of front lifting straps 4A)
19—horizontally-extending back strap
20—side seam connecting front vest material 2 to back vest material 13
21—front strap creating an angled hand-grip lift component 11
22—collar
23—inwardly-tapered side seam (enhances form-fitting configuration of front 2 vest material and back vest material 13 when needed for improved caregiver lifting of a person wearing the present invention vest)
24—stitched dart (enhances form-fitting configuration of front 2 vest material and back vest material 13 when needed for improved caregiver lifting of a person wearing the present invention vest)
25—horizontally-extending upper abdominal strap helping to create the lower front hand-grip lift components 11, and also creating a central horizontally-extending central back hand-grip lift component 11
26—horizontally-extending lower hip area strap helping to create the lower front hand-grip lift components 11

DETAILED DESCRIPTION OF THE INVENTION

Figure 2:
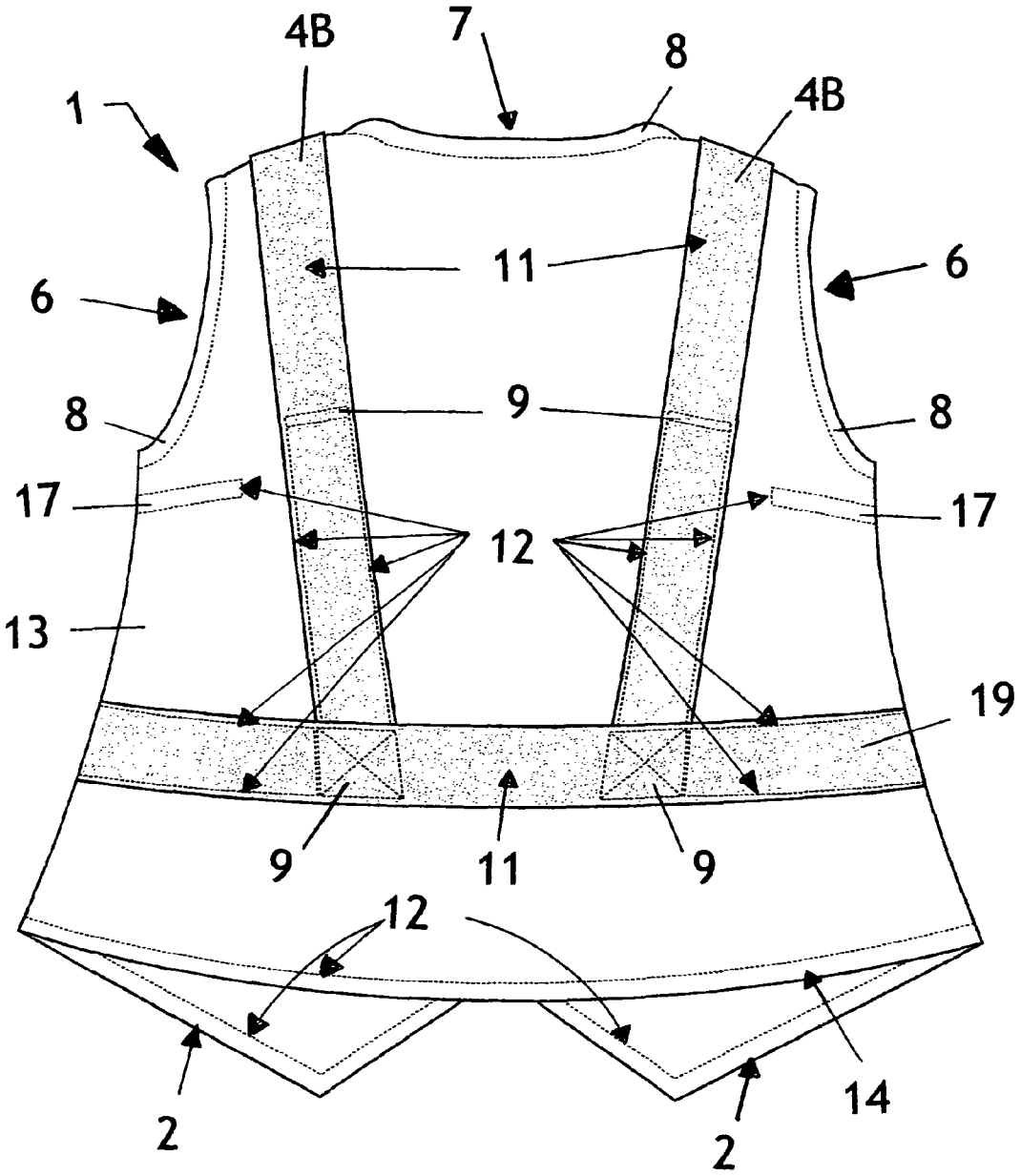
FIG. 2 is a rear view of the most preferred embodiment of the present invention showing two vertically-extending and non-adjustable upper hand-grip lift components located in the upper back area adjacent to the shoulders of the person wearing the manual patient transfer vest, with FIG. 2 also showing a centrally located and horizontally-extending non-adjustable back hand-grip lift component, the vest back material having a shorted length dimension than that of the front vest material, a side fit-adjustment area under each armhole, and soft material added around the neck and arm openings for added user comfort.
Figure 3:
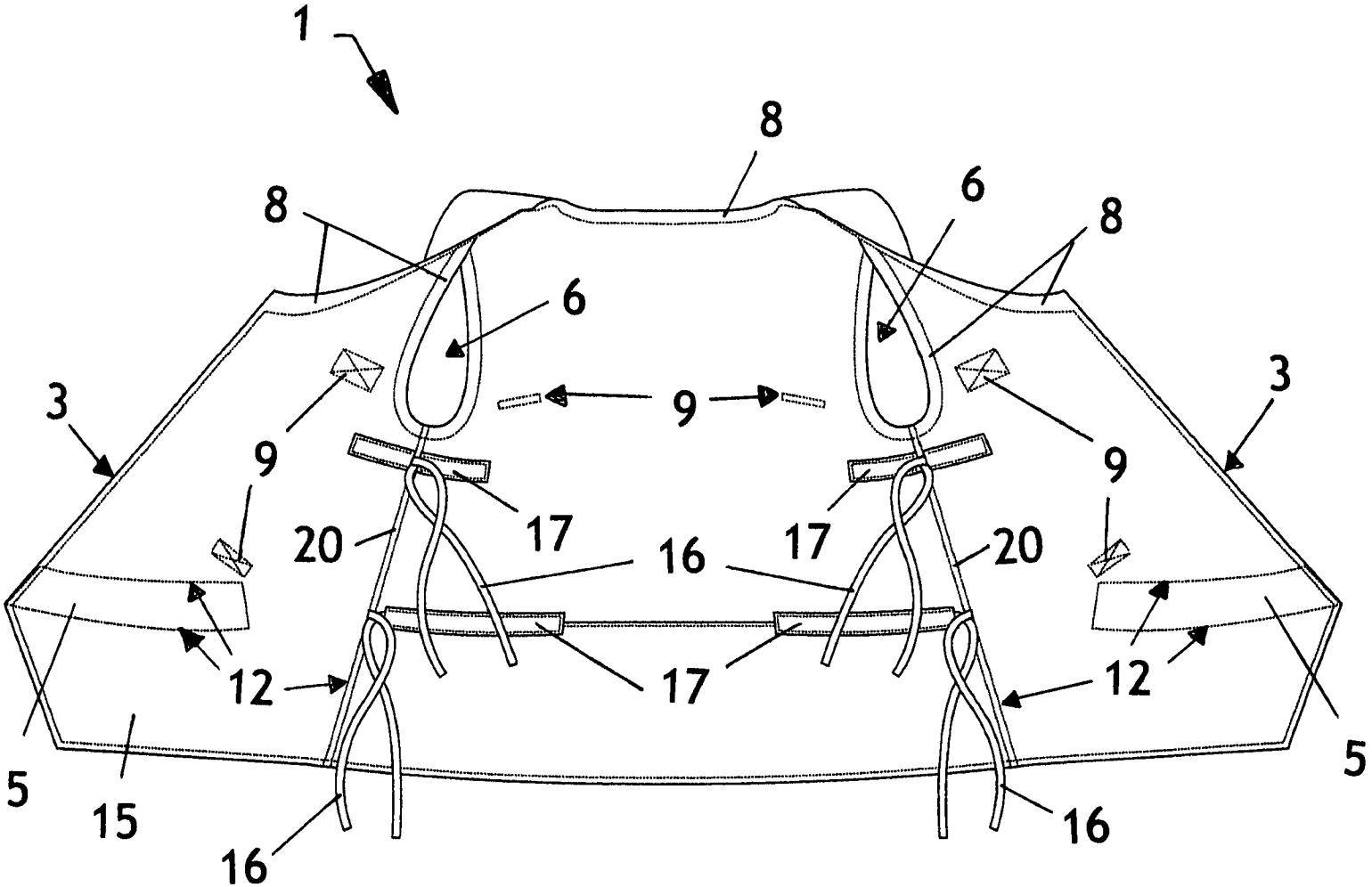
FIG. 3 is an interior view of the most preferred embodiment of the present invention showing its interior adjustment ties and reinforcement stitching.
Figure 4:
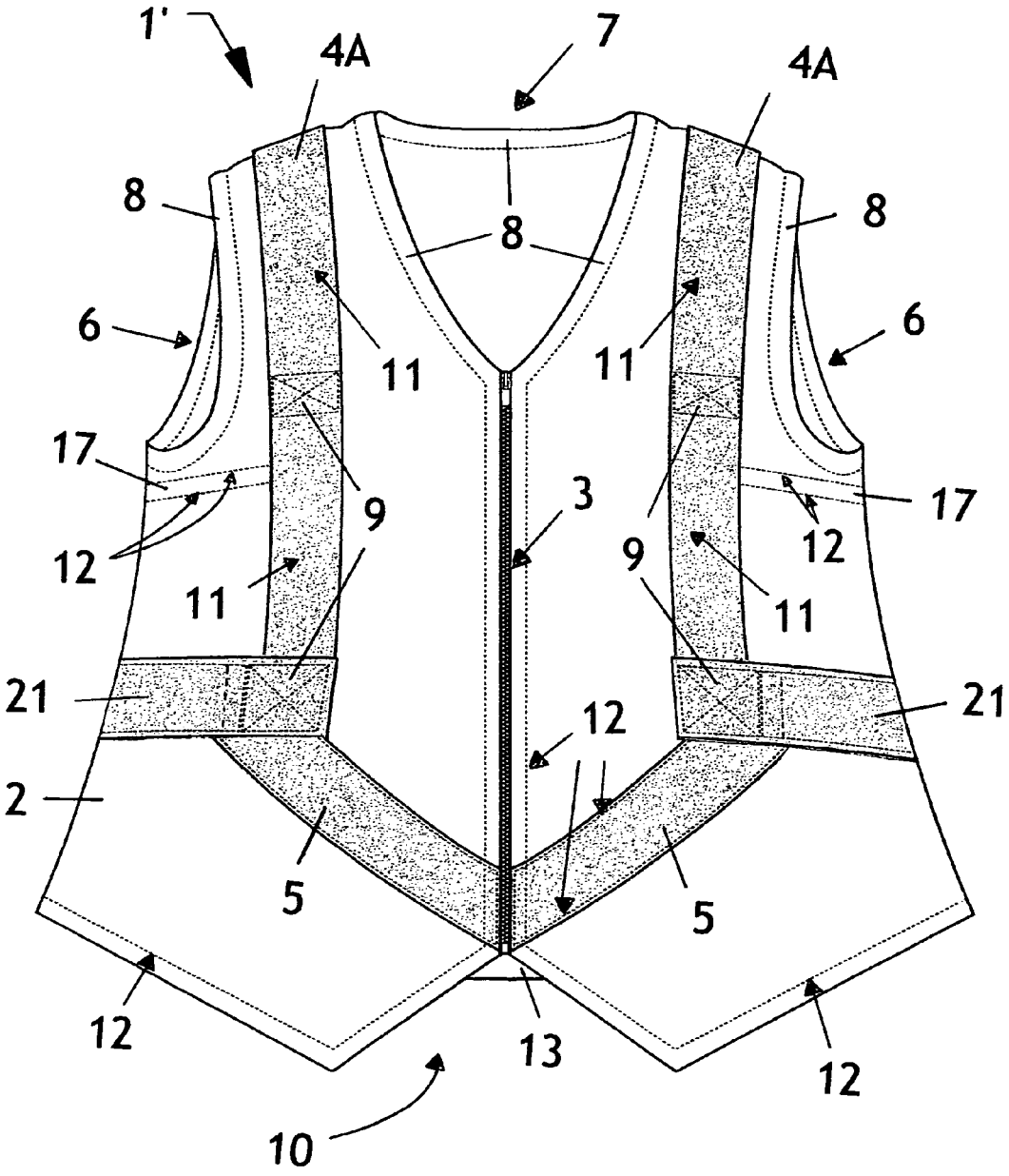
FIG. 4 is a front view of a second preferred embodiment of the present invention manual transfer vest similar to that in FIG. 1, with the exception of a slight repositioning of the lower front hand-grip lift component
Figure 5:
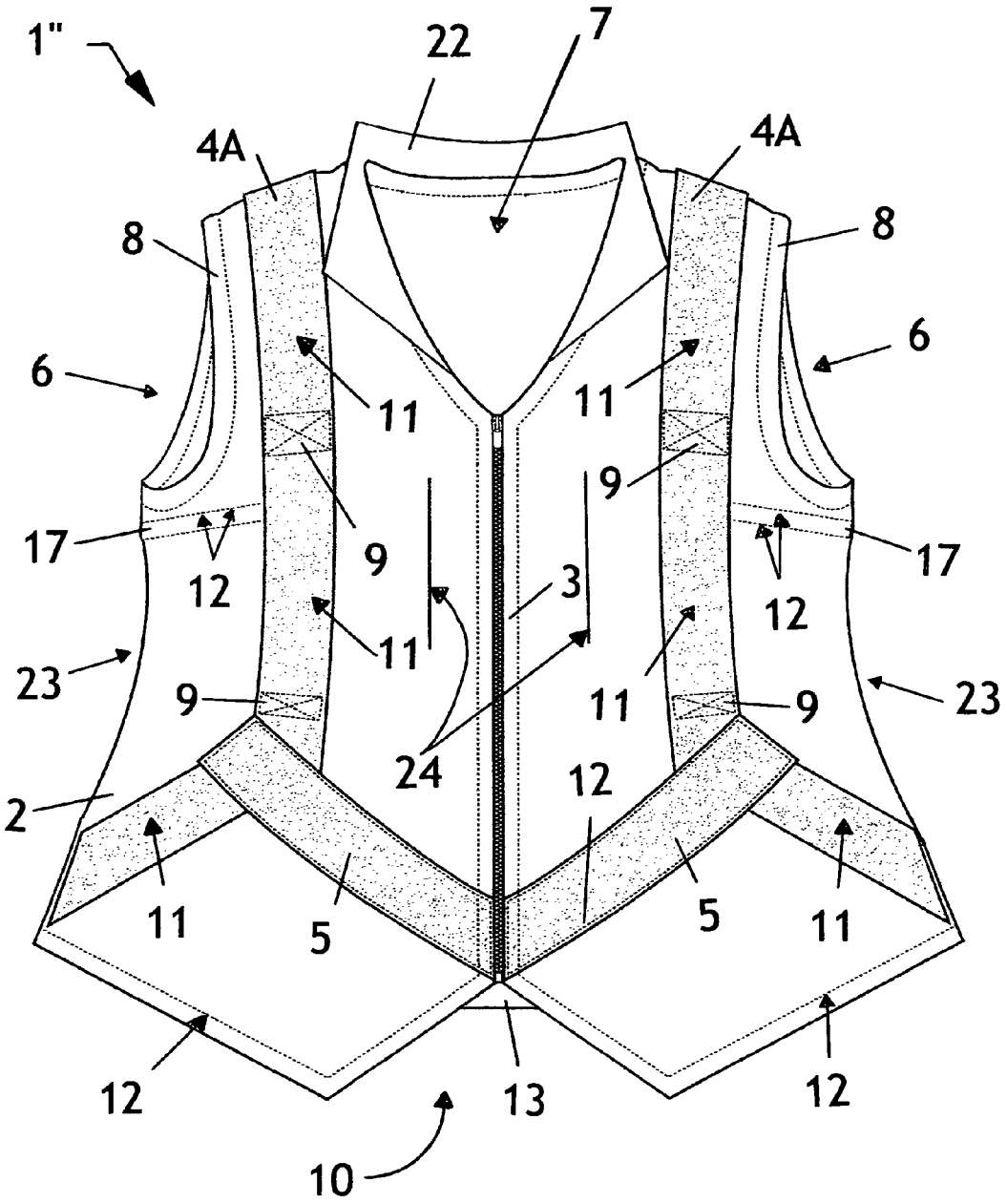
FIG. 5 is a front view of a third preferred embodiment of the present invention manual transfer vest similar to that in FIG. 1, with the exception of the addition of a collar, two vertical stitched darts adjacent to the central zippered closure, and inwardly-tapered side seams that enhance a form-fitted configuration for the vest when needed for improved caregiver lifting of the person wearing the present invention vest.
Figure 6:
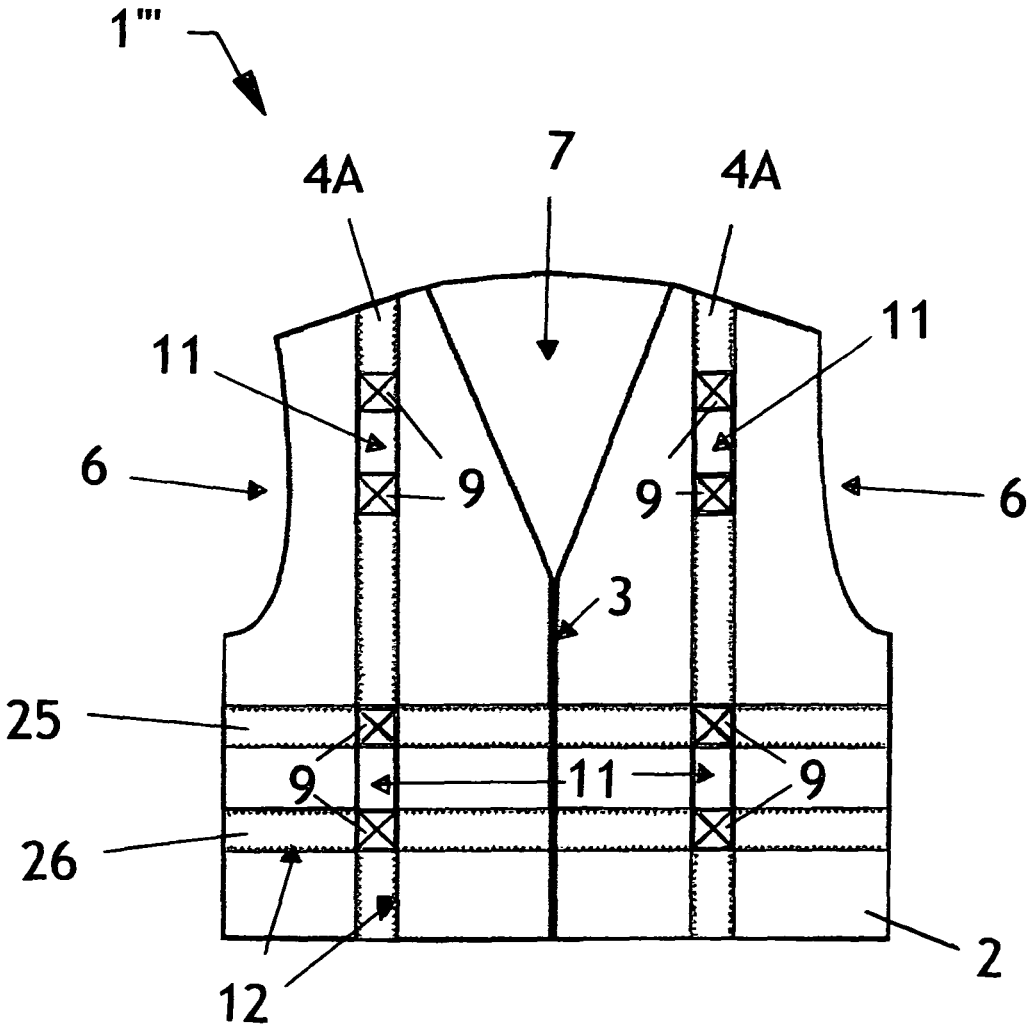
FIG. 6 is a front view of a fourth preferred embodiment of the present invention manual transfer vest with a zippered front closure and four frontal vertically-extending and non-adjustable hand-grip lift components, two of which are upper hand-grip lift components located in the clavicle/upper chest area adjacent to the shoulders of the person wearing the vest, with the other two of the vertically-extending and non-adjustable hand-grip lift components positioned between a horizontally-extending abdominal area strap that completely encircles the vest and a hip area strap below it that also completely encircles the vest, with the vest also having stitched reinforcement areas in key places for the hand-grip lift components to make certain that they remain strong during the lifting of heavy patients and patient lifting that occurs from static and sometimes awkward positions, and the remaining portions of the vertically-extending and horizontally-extending front straps not in use to create hand-grip lift components secured with reinforcement stitching.

The preferred embodiments of the present invention comprise a manual multi-functional patient transfer vest device (such as the most preferred vest 1 shown in FIGS. 1-3) which has patient interfaces, such as but not limited to, the non-adjustable hand-grip lift components 11 shown in FIGS. 1-3, that can be employed for transferring moderately mobility-challenged patients (not shown). FIGS. 4, 5, and 6/7 respectively show second, third and fourth preferred embodiments (1', 1", and 1") of the present invention. In the most preferred embodiment 1, the multi-functional patient transfer vest device is a one-piece, sleeveless vest, with zippered front closure means, that fits snugly and covers the patient's upper back, mid-chest, and waist areas, but does not interfere with a patient's use of a commode. The front of the multi-functional patient transfer vest device 1 has four sturdy and durable vertically-extending, non-adjustable hand-grip lift components 11, with two of the vertically-extending front hand-grip lift components 11 secured bilaterally to the front vest material 2 and extending across the clavicle/upper chest area or shoulder area of a patient wearing it, and the other two of the vertically-extending front hand-grip lift components 11 secured bilaterally to the front vest material 2 and extending across the abdominal/mid-section area of the patient. In addition, in the most preferred vest 1, two more hand-grip lift components 11 are positioned bilaterally in the lower portion of the front vest material 2, each extending in a generally downward direction away from the lower end of a different hand-grip lift component 11 in the patient's abdominal/mid-section area and toward the side of front vest material 2. Furthermore, it is also preferred for the most preferred embodiment 1 of the present invention shown in FIGS. 1-3 to have at least two more hand-grip lift components 11 bilaterally on its back vest material 13 and at least extending across the upper back or shoulder area of the patient wearing it. To create sturdy and durable hand-grip lift components 11 and secure attachment to front vest material 2 and back vest material 13, it is preferred for hand-grip lift components 11 to be made from one elongated lifting strap 4 (having a front portion 4A contiguous with a back portion 4B), and for lifting strap 4 to be secured at least on one end via stitched reinforcement area 9 to front vest material 2 or back vest material 13, forming and strengthening the needed hand-grip lift components 11. As shown in FIGS. 1-3, reinforcing attachment stitching 12 is placed on front angled reinforcement straps 5, and most areas of vertical lifting front straps 4A, vertical lifting back straps 4B, and horizontally-extending back strap 19 where hand-grip lift components 11 are not present.

Manual transfer vest 1 preferably comprises soft, durable, and flexible material to provide patient comfort, with stronger material used in larger sizes intended for heavier patients. The padding 8 surrounding armholes 6 and neck opening 7 in FIGS. 1-4 also contribute to patient comfort, and is a preferred component of the present invention, although not critical. In addition, the outer fabric of manual transfer vest 1 must also be sufficiently strong to support the patient without premature failure during repeat patient lifting and other transfers. Thus, it is also preferred embodiments (1, 1', 1", 1", and other) of the present invention manual transfer vest to have an interior lining 15, which can be made of materials that provide durability and enhanced patient comfort when the present invention is used. The present invention lining 15 may also be made of materials that provide additional warmth when the present invention is used in colder surroundings. In addition, and although not critical, it is preferred for the materials (2, 4, 5, 8, 13, and 15-17) used for preferred embodiments of the present invention manual transfer vest (1, 1', 1", 1", and other) to be machine washable and machine dryable. The hand-grip lift components 11 attached to manual transfer vest 1 can be made from the same material (2 and 13) used to construct its front and back exterior surfaces. In the alternative, hand-grip lift components 11 may be made from different strong and durable strap 4 material as long as it is not stretchable or overly firm to diminish caregiver hand comfort.

While not limited thereto, one preferred material used for the outer/exterior fabric (2 and 13) of manual transfer vest 1 is Rip-Stop Nylon, which is water-resistant, woven, and lightweight, with an imbedded grid designed to stop rips or tears from spidering and getting larger. Rip-Stop Nylon is also machine-washable in warm water and can be tumble dried on medium heat, with a cool iron used as required. Another material contemplated as an outer fabric (2 and 13) for manual transfer vest 1 is Cordura Nylon Fabric, which has a well-established reputation for toughness and durability. Cordura Nylon Fabric is also waterproof, abrasion-resistant, rot-resistant, and mildew-resistant when a clear Polyurethane coating is added. It is also known for its durability and resistance to tears and scuffs. In addition, other materials are contemplated for the outer/exterior fabric (2 and 13) of manual transfer vest 1, including mesh fabrics.

It is also preferable for the interior lining material 15 for manual transfer vest 1 to be durable, soft, and machine washable. Other preferred choices for interior lining material 15 are that it not wear out easily and that it comprise natural textiles, such as cotton, wool or silk, or from synthetic fibers such as rayon or nylon. It is also preferred for interior lining material 15 to offer patient comfort and breathability, as well as be waterproof, shrink-resistant, and heat-resistant. Shrink-resistance is important so that manual transfer vest 1 continues to provide a snug fit around a patient 16, without binding. Lifting strap 4 (including front portion 4A and back portion 4B) also preferably has one-piece construction, a maximum width dimension of approximately two-inches. The thread used as stitching 12 to attach lifting strap 4 to front and back vest material (2, 13) may be a durable upholstery thread made from 100% polyester with a heat-resistant finish or a polyester blend. It is also preferred for manual transfer vest 1 to have a zipper closure 3 made from 100% polyester and a durable plastic that is strong and weatherproof, although other durable closures can be used, including but not limited to one or more hook-and-loop closures, oversized buttons, heavy-duty grippers, or heavy-duty snaps. Although not shown, reinforcement material may be positioned under stitched reinforcement areas 9 between interior lining material 15 and front vest material 2 or back vest material 13 to provide an additional layer of outer vest material (2, 13), or a layer of another material or fabric capable of strengthening the attachment of stitched reinforcement areas 9. Also, more than one layer of reinforcement material made from the same or different materials may be used for strengthening any one, or all, of the stitched reinforcement areas 9.

The design and size of manual transfer vest 1 should allow easy-on and easy-off handling, while also providing a comfortable fit on the person requiring transfer so that each transfer made is smooth and conducted with enhanced patent comfort. The most preferred embodiment of the present invention manual transfer vest 1 is designed without gender preference, and is equally usable by both men and women, without any modification. Manual transfer vest 1 may also be made in solid colors to complement patient clothing, or from materials (2, 4, 5, 8, 13, or 15-17) that display a mixture of colors, textures, and/or designs for variety and/or enhanced aesthetic appeal, and although not shown, as a source of user convenience manual transfer vest 1 may comprise one or more exterior or interior pockets in various locations. Due to the need for a comfortable fit, as mentioned above, it is contemplated for manual transfer vest 1 to be made in a variety of sizes, such as but not limited to small, medium, large, and extra-large. Interior adjustment ties 16 are also secured in interior casings 17 and used to make the present invention fit more snugly around a patient, if needed. Ties 16 could be important for patients expected to lose weight during a stay in a rehabilitative facility, so that one present invention vest (1, 1', 1", 1", and other) can be used the entire rehabilitation with minor adjustments quickly made when periodically needed. Preferred dimensions for a small manual transfer vest 1 include a shoulder-to-shoulder dimension of approximately fourteen inches, a chest dimension of approximately nineteen inches, a hip dimension of approximately twenty inches, and a length dimension of approximately twenty-five inches. Other sizes can also be made proportionally larger or smaller, according to need. As considered appropriate, large, extra large, and even greater sizes of manual transfer vest 1 could have hand-grip lift components 11 with a larger width dimension than is used for small and medium sizes, and the number, placement, size, and/or stitching pattern used for stitched reinforcement areas 9 in any size of manual transfer vest 1 could also be different from that illustrated in FIGS. 1-4 herein.

FIGS. 1-3 show the most preferred embodiment of the present invention manual transfer vest 1. FIG. 1 is a front view of manual transfer vest 1 with a zippered front closure 3 and four frontal and substantially vertically-extending (and non-adjustable) hand-grip lift components 11, two of which are upper hand-grip lift components 11 located in the clavicle/upper chest area adjacent to the shoulders of the person 16 wearing manual transfer vest 1, and two of which are lower hand-grip lift components 11 located lower on manual transfer vest 1 closer to the abdominal/mid-section area of the person 16 wearing it, with manual transfer vest 1 also having a stitched reinforcement area 9 adjacent to at least one end of each hand-grip lift component 11 to strengthen it and make certain that hand-grip lift components 11 maintain a secure attachment to the front portion 2 of manual transfer vest 1 during the lifting of heavy patients and when patient lifting occurs from static and sometimes awkward positions. Hand-grip lift components 11 should be sufficiently large for an adult caregiver to comfortably insert all four fingers through it, but not too large so that the caregiver cannot establish proper leverage to assist the type of patient transfer needed. FIG. 1 also shows one angled reinforcement strap 5 secured across the lower end of each of the front lift strap portions 4A and connected to front vest material 2 and front lift strap portions 4A with attachment stitching 12. As can be further seen is FIG. 1, each angled reinforcement strap 5 is stitched across a different front lift strap portion 4A in a substantially perpendicular orientation thereto that provides enhanced strength for front lift strap portions 4A during patient transfers, particularly a sit-to-stand patient transfer. Although only one reinforcement strap 5 is shown on each side of manual transfer vest 1, it is considered to be within the scope of the present invention for more than one reinforcement strap 5 to be used, particularly in larger custom-ordered manual transfer vests 1, but not limited thereto. Furthermore, the attachment stitching 12 shown in FIGS. 1-3 provides examples of where it might be placed to secure the parts of front lift strap portion 4A not used as a hand-grip lift component 11 to front vest material 2, to secure the parts of back lift strap portions 4B not used as a hand-grip lift component 11 to back vest material 13, to secure angled reinforcement straps 5 to front lift strap portions 4A and front vest material 2, to reinforce front closure 3, and to attach interior casings 17 to interior lining material 15 and front vest material 2 or back vest materials 13, should not be considered as limiting, and the number of stitches-per-inch, placement, nearness to any material edge, and the number of rows of attachment stitching 12 used in any location may be different from that shown. Since the lower portion of each front lift strap portion 4A in FIG. 1 appears to curve downwardly and outwardly toward the sides of manual transfer vest 1, the needed curvature can be formed into front lift strap portions 4A during their manufacture, or provided as a result of making one or more darts or folds in front lift strap portions 4A under the part of the angled reinforcement strap 5 that becomes stitched across it. Also, the lower portion of each front lift strap portion 4A in FIG. 1 may be connected on its bottom end into the side seam 20 (see FIG. 3) connecting front vest material 2 to back vest material 13. Furthermore, for comfort of the person wearing it during stand-to-sit patient transitions, FIG. 1 shows manual transfer vest 1 having preferred enlarged arm holes 6, an enlarged neck opening 7, and a front void space 10 positioned below zipper closure 3. As shown in FIG. 1, it is contemplated for front lift strap portions 4A to have substantially symmetrical placement laterally on front vest material 2 for even and steady transitions of the patient wearing present invention vest (1, 1', and other). Also, as can be seen in FIG. 1, the size of stitched reinforcement areas 9 do not have to be the same size, although they can be. Preferably, the stitched reinforcement areas 9 in present invention vests (1, 1', and other) are sized and shaped according to need, and as shown in FIG. 2 are not required to have a centrally positioned "x" configuration. Although the stitching 12 used to secure interior casings 17 to front vest material 2 is shown in FIG. 1 to be visible while viewing the most preferred embodiment 1 of the present invention, in other preferred embodiments of the present invention not shown herein, interior casings 17 may be secured only to interior lining material 15, or to interior lining material 15 in combination with one or more layers of reinforcement material secured at least in part by one of the side seams 20 connecting front vest material 2 to back vest material 13, or stitching 12 securing padding 8 to front vest material 2, or stitching 12 securing horizontally-extending back strap 19 to back vest material 13.

FIG. 2 is a rear view of the most preferred embodiment 1 of the present invention manual transfer vest showing two vertically-extending and non-adjustable upper hand-grip lift components 11 located in the upper back area adjacent to the shoulders of a person (not shown) wearing it, and the bottom edge 14 of vest back material 13 being shorter than front vest material 2 to assist the person wearing it during use of a commode so that prior removal of manual transfer vest 1 is not required. FIG. 2 also shows a horizontally-extending back strap 19 stitched to vest back material 13 and across the lower ends of back lift strap portions 4B, which helps to strengthen the connection of the lower ends of back lift strap portions 4B to vest back material 13 when transfer movement for a patient wearing manual transfer vest 1 involves the use of either one of the hand-grip lift components 11 located on the portion of back strap components 4B associated with the upper back or shoulders of the person wearing it. Furthermore, in FIG. 2, the back portion of enlarged neck opening 7 and armholes 6 are all shown with attached padding 8 for enhanced patient comfort. FIG. 2 also shows two stitched reinforcement areas 9 associated with horizontally-extending back strap 19, between which not stitching 12 is placed, to create a horizontally-extending lower hand-grip lift component 11. In contrast, stitching 12 is placed laterally from each stitched reinforcement area 9 associated with horizontally-extending back strap 19, extending near the top and bottom edges of horizontally-extending back strap 19 to the side seam 20 (see FIG. 3) joining front vest material 2 to back vest material 13. Although FIG. 2 shows the two stitched reinforcement areas 9 associated with horizontally-extending back strap 19 each having a large configuration and a central "x" configuration, FIG. 2 shows a smaller stitched reinforcement areas 9 without a central "x" configuration associated with each vertically-extending back strap 4B. Thus, FIG. 2 shows reinforcement stitching 12 associated with all portions of vertically-extending back straps 4B and horizontally-extending back strap 19 that do not create a hand-grip lift component 11. In FIG. 2, reinforcement stitching 12 is also shown for the interior casing 17 below each armhole 6 and the bottom edges of the front and back portions of present invention 1. The configuration of all reinforcement stitching 12 on vest 1 is not limited to that shown in FIGS. 1 and 2, and the number of stitches-per-inch, placement, nearness to any material edge, and the number of rows of attachment stitching 12 used in any location in preferred embodiments of the present invention may be different from that shown in FIGS. 1-4.

FIG. 3 is an interior view of the most preferred embodiment 1 of the present invention showing its interior adjustment ties 16, interior casings 17, padding 8 around armholes 6 and neck opening 7, stitched reinforcement areas 9, reinforcement stitching 12, and interior lining material 15 which is preferably soft. The relative sizes of padding 8, interior adjustment ties 16, interior casings 17, and stitched reinforcement areas 9 may vary and are not considered as limited to that shown in FIG. 3. Although not critical, a one-piece construction of each front-to-back-extending lift strap 4 (4A and 4B) from which three hand-grip lift components 11 are created is preferred, with one lift strap 4 extending up and over the right shoulder of the person wearing it, and the second lift strap 4 extending up and over the left shoulder of the person wearing vest 1. FIG. 3 also shows the side seam 20 that connects front vest material 2 to back vest material 13 below armholes 6, which further help to secure the lower ends of front lifting straps 4A. Although only shown for side seams 20, front closure 3, and the bottom edges of front vest material 2 and back vest material 13 near the seam connecting it to lining material 15, it is contemplated for reinforcement stitching 12 to be optionally used adjacent to any seam or edge of manual transfer vest 1 or other embodiment of the present invention, such as but not limited to armhole 6 seams where front vest material 2 and back vest material 13 are connected to lining material 15, enlarged neck hole 7 seams where front vest material 2 and back vest material 13 are connected to lining material 15 and padding 8. FIG. 3 also shows four areas where interior casings 17 and associated ties 16 are preferably located in the most preferred embodiment 1 of the present invention. One interior casing 17 and associated ties 16 are located under each armhole 6, and the remaining two interior casings 17 and associated ties 16 are each located near a different side seam 20 near to the position where horizontally-extending back strap 19 is secured to back vest material 13. In the upper interior casings 17, which as attached to both the front and back portions of vest 1, when the ties 16 are pulled and the lining material 15 attached to casings 17 becomes "gathered" to create a shorter length dimension for the casing 17, and further when the two ties 16 adjacent to the casing 17 are assembled into a knot or bow to fix the length of casing 17, preventing further lengthening of the casing 17 and attached lining material 15 as long as the ties 16 remain in the knot or bow configuration, a tighter fit of vest 1 under the armholes 6 is created for the person wearing vest 1. A similar situation occurs for the lower interior casings 17 attached to the back portion of vest 1, and when the ties 16 associated therewith are pulled and the lining material 15 attached to the lower casings 17 become "gathered" to create a shorter length dimension for one or both of the lower casings 17, and further when the two ties 16 adjacent to each of the lower casings 17 are assembled into a knot or bow to temporarily fix the length of lower casing 17, preventing further lengthening of the lower casing 17 and attached lining material 15 as long as the ties 16 remain in the knot or bow configuration, a tighter fit of vest 1 in the lower back portion of vest 1 is created for the person wearing it. When any of the ties 16 are released from the temporary knot or bow configuration (not shown), the associated lower interior casing 17 or upper interior casings 17 lengthen, returning to their original configuration. The ties 16 and casings 17 allow slight adjustments to the fit of vest 1 around the person wearing it to maximize patient transitions with minimum caregiver effort and maximum patient comfort.

FIGS. 4 and 5 respectively show second and third preferred embodiments (1' and 1") of the present invention FIG. 4 is a front view of a second preferred embodiment 1' of the present invention manual transfer vest similar to that in FIG. 1, with the exception of a slight repositioning of each of the lower front hand-grip lift components 11. Instead of having the bottom end of each front lift strap portion 4A having a different angled reinforcement strap 5 stitched across it in a substantially perpendicular orientation thereto, each front lift strap portion 4A extends approximately to one of the angled reinforcement straps 5, with a non-vertical front strap 21 creating an angled hand-grip lift component 11 while secured by an enlarged stitched reinforcement area 9 across the bottom end of front lift strap portion 4A and the upper end of angled reinforcement strap 5. The end of non-vertical front strap 21 not secured by the enlarged stitched reinforcement area 9 is preferably secured by the adjacent side seam 20, or could be configured as an extension of the horizontally-extending back strap 19. The angle of non-vertical front strap 21 and the size and configuration of the stitched reinforcement area 9 securing it to front vest material 2 can be different from that shown in FIG. 4. As mentioned above, the angled reinforcement straps 5 is stitched across at lease a portion of the front lift strap portion 4A, provide enhanced strength for front lift strap portions 4A during patient transfers, particularly a sit-to-stand patient transfer. FIG. 5 is a front view of a third preferred embodiment 1" of the present invention manual transfer vest similar to that in FIG. 1, with the exception of the addition of a collar 22, two vertical stitched darts 24 adjacent to the central zippered closure 3, and inwardly-tapered side seams 23 that enhance a form-fitted configuration for front vest material 2 and back vest material 13 when needed for improved caregiver lifting of the person wearing the present invention vest.

Figure 7:
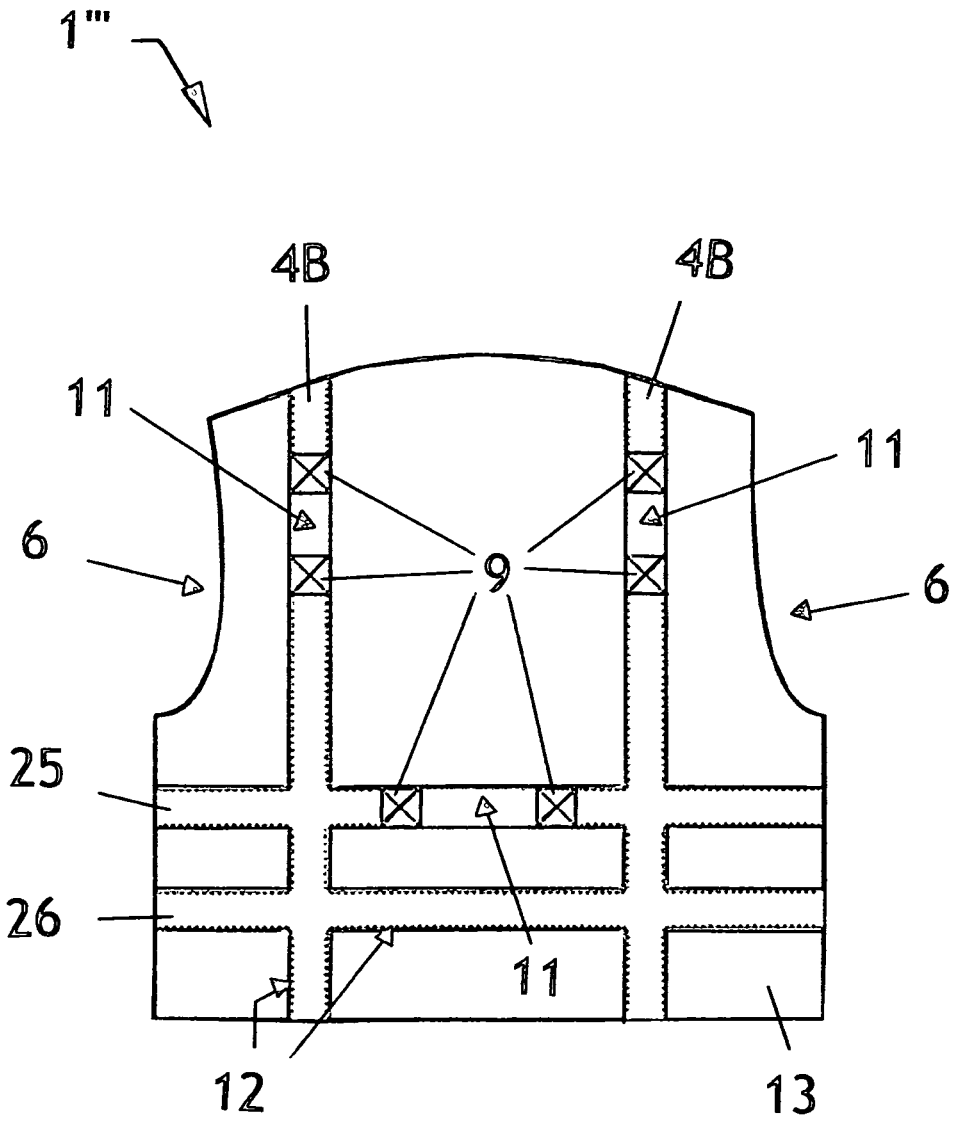
FIG. 7 is a back view of a fourth preferred embodiment of the present invention manual transfer vest having two vertically-extending and non-adjustable back hand-grip lift components located in the upper back area adjacent to the shoulders of the person wearing the vest, with another horizontally-extending and non-adjustable back hand-grip lift component centrally positioned as a part of the horizontally-extending abdominal area strap that completely encircles the vest, with the vest also having stitched reinforcement areas in key places for the hand-grip lift components to make certain that they remain strong during the lifting of heavy patients and patient lifting that occurs from static and sometimes awkward positions, and the remaining portions of the vertically-extending and horizontally-extending front straps not in use to create hand-grip lift components secured with reinforcement stitching.

FIGS. 6 and 7 show a fourth preferred embodiment 1' of the present invention manual transfer vest. FIG. 6 is a front view of the fourth preferred embodiment of the present invention manual transfer vest with a zippered front closure 3 and four front vertically-extending and non-adjustable hand-grip lift components 11, two of which are upper hand-grip lift components 11 located in the clavicle/upper chest area adjacent to the shoulders of the person wearing the vest, with the other two of the vertically-extending and non-adjustable hand-grip lift components 11 positioned between a horizontally-extending abdominal area strap 25 that completely encircles the vest material (2/13) and a hip area strap 26 below it that also completely encircles the vest material (2/13), with the vest 1' also having stitched reinforcement areas 9 in key places for the hand-grip lift components 11 to make certain that they remain strong during the lifting of heavy patients and patient lifting that occurs from static and sometimes awkward positions. The remaining portions of the vertically-extending and horizontally-extending front straps 4A not in use to create hand-grip lift components 11 secured with reinforcement stitching 12. FIG. 7 is a back view of the fourth preferred embodiment 1' of the present invention manual transfer vest having two vertically-extending and non-adjustable back hand-grip lift components 11 located in the upper back area adjacent to the shoulders of the person wearing the vest, with another horizontally-extending and non-adjustable back hand-grip lift component 11 centrally positioned as a part of the horizontally-extending abdominal area strap 25 that completely encircles the vest material (2/13), with the vest 1' also having stitched reinforcement areas 9 in key places for the hand-grip lift components 11 to make certain that they remain strong during the lifting of heavy patients and patient lifting that occurs from static and sometimes awkward positions, and the remaining portions of the vertically-extending and horizontally-extending front straps not in use to create hand-grip lift components 11 secured with reinforcement stitching 12.

To use the present invention, the patient (not shown) first dons manual transfer vest 1 and its front closure 3 (preferably the zipper closure 3 shown in FIG. 1) is secured so that manual transfer vest 1 completely enwraps the torso of the patient and provides a snug, but not too restrictive, fit around it. Should a slight tightening adjustment of vest 1 around the upper torso be needed, the interior ties beneath armholes 6 can be pulled and formed into a knot or bow to gather the associated casing 17 and its attached interior lining material 15. In the alternative, should a slight tightening adjustment of vest 1 around the lower torso be needed, the lower interior ties 16 (one attached to the adjacent side seam 20 and the other secured inside the interior end of casing 17) can be used to gather the associated casing 17 and its attached interior lining material 15 with the tie 16 inside casing 17 being pulled and secured in a temporary knot or bow with the tie 16 secured to side seam 20. The gathering can be released any time that the joined ties 16 are released from their knotted or bow configuration. Also, repeat adjustment of vest 1 with ties 16 can be conducted as many times as needed. For a frontal sit-to-stand transfer, patient 16 is in a sitting position. Using good body mechanics, the caregiver (not shown) would stand with knees slightly bent and leaning slightly forward in front of the patient wearing vest 1. The caregiver would then place each hand within a different hand-grip lift component 11 on opposite sides of front closure 3, and with ease and providing a controlled and gentle lift upward, the caregiver steadily assists the patient into a standing position. In contrast, for a lateral bed transfer, the caregiver would have the patient wearing vest 1 lie on his/her side and place both legs over the edge of the bed; then with ease and control, the caregiver would use the appropriate hand-grip lift component 11 (nearest the shoulder side down) to gently assist the patient to a sitting position. For a repositioning maneuver of a patient in bed, the caregiver would align and reposition the patient at the head of the bed by placing one hand in each of two different hand-grip lift components 11 and with ease and control, gently pull the patient wearing vest 1 upward until positioned at the head of the bed. The repositioning maneuver can also be accomplished with a two-person assist. In addition, for promoting a steady gate during safe ambulation while walking along side of a patient wearing vest 1, the caregiver would place one hand through one hand-grip lift component 11 (front or back), which would steady the gait of the patient, thereby reducing the risk of him or her tripping or falling. This safe ambulation maneuver can also be accomplished by a two-person assist, with one person walking on each side of the patient wearing vest 1 and each holding onto one or more hand-grip lift component 11 (front or back).

While the written description of the invention herein is intended to enable one of ordinary skill to make and use its best mode, it should also be appreciated that the invention disclosure only provides examples of specific embodiments and methods, and examples, and many variations, combinations, and equivalents also exist which are not specifically mentioned. The present invention should therefore not be considered as limited to the above-described embodiments, methods, and examples, or the language in the accompanying Abstract, but instead encompassing all embodiments and methods within the scope and spirit of the invention, as defined in the accompanying claims.

We claim:

1. A manual transfer and lift garment allowing a caregiver to easily maneuver a patient from one position to another, said garment comprising:

a vest having a front exterior surface and a back exterior surface, said vest also having two armholes, a front closure with closed positioning allowing said vest to have a torso-surrounding orientation, and a neck opening the front portion of which has a V-shaped configuration when said front closure adopts said closed positioning;

two elongated and substantially vertically-extending front lifting straps each having a portion thereof secured to said front exterior surface of said vest with attachment stitching, each said front lifting strap positioned at least in part between said neck opening and a different one of said armholes that results in positioning of said two front lifting straps on different sides of said front closure, each said front strap also securely attached to said front exterior surface with at least one stitched reinforcement area in a manner that creates at least one substantially vertically-extending front hand-grip lift component detached from said front exterior surface and non-adjustable in length, wherein said at least one stitched reinforcement area is positioned above and below each said hand-grip lift component;

two elongated and substantially vertically-extending back lifting straps secured to said back exterior surface of said vest, each said back lifting strap having an upper portion positioned at least in part between said neck opening and a different one of said armholes, each said upper portion of each said back strap also securely attached to said back exterior surface of said vest with at least one stitched reinforcement area in a manner that creates at least one substantially vertically-extending back hand-grip lift component detached from said back exterior surface and non-adjustable in length, and attachment stitching securely connecting parts of each said back strap not creating said at least one back hand-grip lift component to said back exterior surface of said vest; and one horizontally-extending back lifting strap connected by at least one stitched reinforcement area to each of said elongated and substantially vertically-extending back lifting straps and creating at least one substantially horizontally-extending back hand-grip lift component detached from said back exterior surface and non-adjustable in length, said back lifting strap also having attachment stitching securely connecting parts thereof not creating said at least one back hand-grip lift component to said back exterior surface of said vest, wherein when said vest is worn by an ambulatory patient with said front closure adopting said closed positioning, said front and back hand-grip lift components may be used by a caregiver in varying combinations for assisting patient ambulation to prevent falls, for patient movement and transfers, and to manually raise a patient from a seated position into a standing position.

2. The manual transfer and lift garment according to claim 1 wherein each said front lifting strap secured to said front exterior surface creates two hand-grip lift components one substantially above the other.

3. The manual transfer and lift garment according to claim 1 wherein at least one of said front lifting straps has unitary construction with one of said back lifting straps creating a continuous length.

4. The manual transfer and lift garment according to claim 1 further comprising at least one interior adjustment tie in association with interior casing material.

5. The manual transfer and lift garment according to claim 1 further comprising interior lining material connected to said front and back exterior surfaces and at least one layer of reinforcement material associated with at least one said stitched reinforcement area, and further wherein said at least one layer of reinforcement material is selected from a group consisting of reinforcement material situated between said lining material and said front exterior surface and reinforcement material situated between said lining material and said back exterior surface.

6. The manual transfer and lift garment according to claim 5 wherein said interior lining material is selected from a group consisting of soft material, flexible material, mesh material, lightweight material, material preserving body warmth, breathable fabrics, durable fabrics, tear-resistant fabrics, washable fabrics, non-stretchable fabrics, fast-drying fabrics, waterproof fabrics, heat-resistant fabrics, shrink-resistant fabrics, mildew-resistant fabrics, and rot-resistant fabrics.

7. The manual transfer and lift garment according to claim 1 wherein said two back lifting straps each have a lower end and wherein said back exterior surface further comprises a separate lower portion connected to the remainder of said back exterior surface in a manner that secures said lower ends of said back lifting straps.

8. The manual transfer and lift garment according to claim 1 wherein said front closure comprises a centrally-positioned zipper.

9. The manual transfer and lift garment according to claim 1 further comprising a horizontally-extending abdominal area reinforcement strap and a horizontally-extending hip area reinforcement strap, said horizontally-extending abdominal area reinforcement strap and said horizontally-extending hip area reinforcement strap each extending across said front exterior surface and said back exterior surface of said vest.

10. The manual transfer and lift garment according to claim 9 wherein said horizontally-extending abdominal area reinforcement strap and said horizontally-extending hip area reinforcement strap together with said two elongated and substantially vertically-extending front lifting straps and four stitched reinforcement areas create two hand-grip lift components.

11. The manual transfer and lift garment according to claim 9 wherein said horizontally-extending abdominal area reinforcement strap and two stitched reinforcement areas create said horizontally-extending back lifting strap.

12. The manual transfer and lift garment according to claim 1 wherein said armholes and said neck opening have at least one added layer of soft padding, promoting enhanced patient comfort.

13. The manual transfer and lift garment according to claim 1 further comprising a collar.

14. The manual transfer and lift garment according to claim 1 wherein said arm openings are enlarged, promoting enhanced patient comfort.

15. The manual transfer and lift garment according to claim 1 wherein said neck area is enlarged, promoting enhanced patient comfort.

16. The manual transfer and lift garment according to claim 1 further comprising at least one interior adjustment tie.

17. The manual transfer and lift garment according to claim 16 comprising two said interior adjustment ties, one below each said armhole.

18. The manual transfer and lift garment according to claim 1 wherein each said elongated and substantially vertically-extending front lifting strap has a lower end creating an angled hand-grip lift component.

19. The manual transfer and lift garment according to claim 1 further comprising form-fitting enhancement selected from a group consisting of inwardly-tapered side seams and stitched darts.

* * * * *